United States Patent [19]

Rössler et al.

[11] 4,128,675

[45] Dec. 5, 1978

[54] PROCESS FOR TREATING TEXTILES WITH REACTIVE POLYMERS

[75] Inventors: Erich Rössler, Leitershofen; Hans Deiner, Neusäss; Bernhard Sandner, Diedorf; Hans Schilling, Langweid, all of Germany

[73] Assignee: Ciba-Geigy Corporation, Ardsley, N.Y.

[21] Appl. No.: 786,162

[22] Filed: Apr. 11, 1977

[30] Foreign Application Priority Data

Apr. 15, 1976 [DE] Fed. Rep. of Germany ..... 2616797

[51] Int. Cl.[2] ..... B05D 3/02

[52] U.S. Cl. ..... 427/390 E; 260/29.6 NR; 260/29.6 T; 260/29.6 MN; 260/827; 427/392; 428/447; 428/521; 428/522

[58] Field of Search ..... 260/46.5 E, 29.6 NR, 260/29.6 T, 29.6 MN; 427/390 E, 392; 428/288, 293, 521, 522, 447

[56] References Cited

U.S. PATENT DOCUMENTS 3,352,710 11/1967 Wolf et al. ..... 428/293 X 3,812,070 5/1974 Kelley ..... 260/29.6 NR X

FOREIGN PATENT DOCUMENTS 46-28998 8/1971 Japan ..... 427/390 E 809822 3/1959 United Kingdom ..... 427/390 E

*Primary Examiner*—Michael R. Lusignan

*Attorney, Agent, or Firm*—Edward McC. Roberts

[57] ABSTRACT

An aqueous medium containing reactive polymers, the reactive groups being N-methylol and/or etherified N-methylol groups, preferably based on methylolated, etherified or not, unsaturated carboxylic acid amides, included by polymerization, the portion of said reactive monomers being preferably 2.5 to 20% by weight, related to the total weight of the polymers, is applied to textiles by impregnation or preferably by coating in the presence of silanes and/or siloxanes containing amino groups and organometallic compounds, preferably zinc soaps and/or dialkyl-tin dicarboxylates as hardening agents, and heated at elevated temperature. A waterproof and water-repellent finish is obtained, resistant to washing and dry cleaning.

17 Claims, No Drawings

PROCESS FOR TREATING TEXTILES WITH REACTIVE POLYMERS

The present invention relates to a process for treating textiles with reactive polymers. In particular the invention relates to the treatment of textiles with an aqueous medium containing polymers which contain, as reactive groups, N-methylol groups and/or N-methylol groups esterified with $C_1$ to $C_3$ alcohols and to compositions for use therein.

Reactive polymers or copolymers, which are synthesised from the esters of acrylic and methacrylic acids and also those from a vinyl acetate base, which contain N-methylol groups as reactive groups, are known. These polymers are used as finishing agents for woven cellulose fabrics, as bonding agents for bonded non-woven fibrous structures, as binders in printing pastes or for similar purposes as disclosed for example, in British Patent Specification Nos. 882,743 and 1,345,123 and U.S. Pat. No. 3,352,710.

It is also known to use aqueous dispersions of these reactive copolymers, together with conventional thickening agents and synthetic resins, for the coating of fibrous materials, more especially for obtaining a waterproof finish.

When such materials are treated with these polymers, a water-tight impregnation is obtained, but the finish is not water-repellent or has unsatisfactory water-repelling properties. With such a finish the water remains adhering to the treated fibre materials and, with wear and tear over a relatively long period of time, this leads to a gradual swelling and eventually to a destruction of the polymer and hence to a penetration of the water into the interior of the fibre or to water passing completely through the fibre material. In addition, the resistance to washing and dry cleaning, using known processes, leaves much to be desired since the initially good waterproof effect quickly decreases with repeated washing and/or cleaning.

It has now surprisingly been found that the disadvantages of the prior art may be obviated by using selected reactive copolymers in the presence of specific hardening agents.

According to the present invention there is provided a process for the treatment of textiles in which an aqueous medium containing reactive copolymers which are stable in aqueous medium and are based on ethylenically unsaturated compounds, the reactive copolymers containing as reactive groups, N-methylol groups and/or N-methylol groups etherified with alcohols containing 1 to 3 carbon atoms, is applied to textiles in the presence of catalytic amounts of silanes containing amino groups and/or siloxanes containing amino groups and one or more organometallic catalysts as hardening agents, and heated at elevated temperatures.

Also according to the invention there is provided a composition for the treatment of textiles comprising an aqueous medium containing reactive copolymers which are stable in aqueous medium and are based on ethylenically unsaturated compounds, the reactive copolymers containing, as reactive groups N-methylol groups and/or N-methylol groups etherified with alcohols containing 1 to 3 carbon atoms, and as hardening agents for the reactive copolymers catalytic amounts of silanes containing amino groups and/or siloxanes containing amino groups and one or more organometallic catalysts.

In accordance with the process of the invention, reactive copolymers which are based on ethylenically unsaturated compounds are used, which are stable in aqueous medium, i.e. they do not hydrolyse. As reactive groups, the compounds contain N-methylol groups, preferably carboxylic acid amide-methylol groups, or etherified N-methylol groups, in which alcohols having 1 to 3 carbon atoms, preferably methanol, are used for the etherification. Suitable monomers by which these groups may be introduced into the copolymer, include N-addition products of formaldehyde to methacrylamide or acrylamide, allyl or methallyl carbamates, the corresponding monomethylol compounds advantageously being incorporated by polymerisation. Besides, N-methylol acrylamides etherified with methanol are also suitable. Less suitable are, for example, the N-methylol compounds of N-vinyl ethylene and N-propylene ureas or their ethers with $C_1$ to $C_3$ alcohols. The copolymers which are employed in accordance with the invention generally contain at least 1.5% by weight and advantageously 2.5 to 20% by weight, more preferably 2.5 to 12% by weight, based on the total weight of the polymer of these reactive monomers included by polymerisation. A subsequent methylolation, using corresponding monomers, is also possible in certain cases.

The monomers additionally included in the copolymers by polymerisation are known. These reactive copolymers are, for example, mainly synthesised using vinyl esters, more especially vinyl acetate, but more preferably using methacrylic or acrylic acid esters, e.g. methacrylic or acrylic acid esters of alcohols having 1 to 8 carbon atoms, e.g. methanol, ethanol, butanol, isobutanol, n-hexanol and 2-ethyl hexanol. These monomers are usually contained in the copolymer in amounts from 50 to 98.5% by weight based on the total weight of polymer.

In addition, the copolymers which are used in accordance with the invention may optionally contain, incorporated by polymerisation, up to a total 25% by weight, based on the total weight of polymer, of other compounds with a polymerisable double bond. Suitable comonomers of this type include ethylene, acrylonitrile, methacrylonitrile, acrylamide, styrene, vinyl ether, vinyl chloride and vinylidene chloride. Larger amounts of monomers with free COOH groups (more than 1% by weight) are not suitable, because the same may cause precipitations with the aminosilane or aminosiloxane.

Additionally small quantities, namely, less than 5% by weight, calculated on the total weight of polymer, of compounds having two polymerisable double bonds can be included. Examples of such monomers include butanediol diacrylate, divinyl benzene and methylene-bis-acrylamide.

The copolymers described are known and are disclosed in British Patent Specification Nos. 882,743 and 1,345,123 and U.S. Pat. Nos. 3,352,710 and 3,380,851. The copolymers are commercially available in the form of approximately 30 to 70% aqueous dispersions.

The copolymers described above are applied to textiles in an aqueous medium and are crosslinked on the textile material using certain hardening agents. The hardening agents used in the invention are silanes and/or siloxanes containing amino groups, together with organometallic catalysts.

Preferred silanes containing amino groups are those of the formula:

$$M-A-\overset{\overset{Y_n}{|}}{Si}-(OY)_{3-n} \quad (I)$$

in which Y represents an alkyl group having 1 to 3 carbon atoms, A represents an alkylene group with more than 2 and preferably 3 or 4 carbon atoms, M represents an amino group or diaminoalkyl group, which is bonded to A via a carbon-nitrogen bond, and $n$ is 0 or 1.

Examples of aminosilanes of formula (I) are:

| | |
|---|---|
| $H_2N(CH_2)_3Si(OC_2H_5)_3$ | (1) |
| $H_2N(CH_2)_3Si(OC_3H_7)_3$ | (2) |
| $H_2N(CH_2)_2NH(CH_2)_3Si(OC_2H_5)_3$ | (3) |
| $H_2N(CH_2)_2NH(CH_2)_3Si(OCH_3)_3$ | (4) |
| $H_2N(CH_2)_6NH(CH_2)_3Si(OC_2H_5)_3$ | (5) |
| $H_2N(CH_2)_3Si(OC_2H_5)_2$ (with $CH_3$ on Si) | (6) |
| $H_2N(CH_2)_2NH(CH_2)_3Si(OC_3H_7)_3$ | (7) |
| $H_2N(CH_2)_4Si(OC_2H_5)_3$ | (8) |
| $H_2N(CH_2)_6Si(OCH_3)_3$ | (9) |

The aminosilanes of formula (I) are preferably used as silanes containing amino groups, since they are readily available and produce particularly advantageous effects. However, other aminosilanes may also be employed, for example (β-aminoethoxy)-propyl trimethoxysilane, (β-aminopropoxy)-butyl tributoxysilane, methyl-(β-aminopropoxy)-propyl-di-(aminoethoxy)silane and (β-aminoethoxy)-propyl methyl dimethoxysilane.

The preferred siloxanes containing amino groups for use in the invention are the hydrolysates of the compounds of formula (I) and the cohydrolysates of these compounds with silanes which have no amino groups, but as regards the cohydrolysates, the proportion of the aminosilanes of formula (I) is preferably predominant.

Examples of amino-functional siloxanes are:

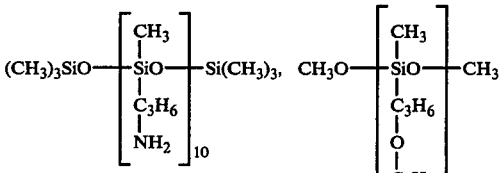

(10)

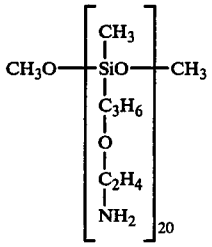

(11)

and

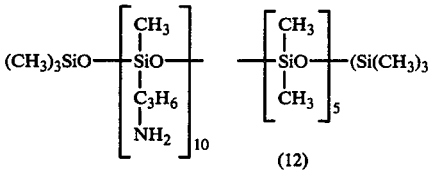

(12)

The silanes and/or siloxanes which contain amino groups are used in admixture with organometallic catalysts as hardening agents. Suitable compounds for use as hardening agents include zinc, tin and zirconium caprylates, tin and zinc octoates, aluminium alcoholate, alkyl titanates, alkyl zirconates, zinc, tin, zirconium, ferric and cobalt naphthenates, zinc and zirconium formates, tin, zinc and zirconium acetates, as well as dibutyl-tin dicaprylate, dilaurate, diacetate and maleinate, dioctyltin diformate, dibenzoate and dicrotonate.

Preferably zinc soaps and more preferably dialkyl-tin dicarboxylates are concurrently employed. These compounds cause a particularly fast and complete crosslinking, so that a reliable performance is guaranteed when such compounds are used. The uniform crosslinking and hence improvement in the properties is particularly pronounced with the concurrent use of the dialkyl-tin dicarboxylates.

In the process of the invention, the amount of hardening agent used is generaly in the range 1.0 to 30% and preferably 1.0 to 20% by weight, calculated on the total weight of the copolymer. The aminosilane and/or aminosiloxane and organometallic catalysts are advantageously used in approximately equal quantities. It is possible in principle to use higher quantities, but these do not produce any appreciable improvement in the effect. Preferably the hardening agent is a mixture of 0.5 to 10% by weight, more preferably 2 to 8% by weight, of silanes and/or siloxanes containing amino groups, and 0.5 to 10% by weight, more preferably 2 to 8% by weight, or organometallic catalysts based on the weight of the copolymer calculated as solids. Preferably zinc soaps and dialkyl-tin dicarboxylates are the organometallic catalysts.

The process of the invention is carried out in aqueous medium. In this respect, it is possible for up to 50% by weight based on the weight of water (with impregnation, a suitable smaller amount), of organic water-insoluble solvents to be concurrently employed. A better wetting of the textiles to be treated is achieved by the additional use of these organic solvents. Examples of organic, water-insoluble solvents include aromatic and aliphatic hydrocarbons, e.g. halogenated, aliphatic and aromatic hydrocarbons, such as tetrachlorethylene, trichlorethylene and chlorobenzene.

The water is used in varying amounts, depending on whether the textile material is to be coated, which is preferred, or whether an impregnation, i.e. a saturation, of the textile material is to be effected by sizing, spraying, padding or the like.

The process of treating textiles in accordance with the invention is particularly suitable for coating textiles, but is also suitable for impregnating textiles of all types.

When coating, the reaction copolymers are well mixed in the form of the aqueous dispersions generally in an amount in the range 15 to 60% by weight, based on the total weight of coating composition. The aqueous composition generally contains the hardening agent, and optionally white and/or coloured pigments, such as titanium dioxide, permanent white (barium sulphate), carbon black or conventional organic and inorganic pigment dyestuffs, or even only fillers, such as kaolin, colloidal silicon dioxide, talcum or alumina. Organic, water-insoluble solvents are optionally added. The aqueous dispersions of the reactive copolymers only have a viscosity from about 70 to 1000 cP (at 20° C.) whereas compositions having a viscosity of advantageously 10,000 to 60,000 cP (at 20° C.) are necessary for the coating and therefore the introduction of conventional thickeners is additionally necessary.

Suitable thickeners are the preparations which are known from the printing of textiles, e.g. starch and modified starch, plant resin and mucillages, such as tragacanth, alginates and carob bean flour, cellulose derivatives, e.g. carboxymethyl cellulose and hydroxyethyl cellulose, and synthetic thickeners, e.g. polyacrylic acid. The composition is adjusted to the required viscosity with these thickening agents, and generally it is only necessary to use small amounts, e.g. 0.4 to 6% by weight, based on the weight of coating composition.

The coating composition is applied in known manner by doctoring, e.g. with rollers or especially with air and rubber cloth doctors, brushing, printing and the like to the textile material which is to be treated. In practice, the operation is usually carried out continuously, whereas in the laboratory, the coating composition is for example brushed on intermittently. When using the continuous operating procedure, the fabric, depending on the material, runs at a speed from 5 to 25 m/min and, immediately after the application, is conveyed through a heating duct and is dried at temperatures from 100° to 190° C. and is optionally cured, the retention time being on average between half a minute and 6 minutes. The coating is normally between 5 and 100 g/m$^2$. Lighter materials, which are processed into leisure clothing and rainwear or umbrellas, are given a coating from 5 to 20 g/m$^2$. Materials of medium weight, such as canvas, sailcloth, tent and awning materials or towelling, are provided with 20 to 70 g/m$^2$, and heavier materials, such as more especially industrial fabrics, are given a coating up to 100 g/m$^2$ (amounts related to solid substance), it being desirable or necessary, especially with relatively high applied quantities and for producing a uniform, coherent film, to apply the required coating quantity in two or more coating operations. Most articles are only coated on one side, but it is possible in like manner for the other side to be provided with a coating.

The materials which are coated on both sides and in particular those which are coated on one side are frequently post-impregnated. An optimisation of the effects is achieved by this post-impregnation and, in addition, when the coating is only on one side, the other side is also provided with a more especially water-repelling finish. The post-impregnation is carried out in a conventional manner, using the known finishing agents, e.g. silicone emulsions and paraffin emulsions containing metal salts, and can also be combined with an oleophobic, rot-proof and/or crease-resistant finish using known finishing or dressing agents. The procedural technique as regards the post-impregnation is conventional. As a general rule, a sizing operation is carried out and then the finishing is effected by drying and curing. This additional impregnation can also take place prior to the coating.

During the impregnation, depending on the liquor absorption and the required effect, 4 to 100 g/l (larger quantities are not advisable on economic grounds) and usually 5 to 40 g/l of the copolymer and the hardening agent are stirred into water, optionally organic, water-insoluble solvents are added and treatment is carried out in the usual manner by dipping and squeezing (padding), nip-padding or spraying. The material is thereafter dried and, depending on the material being treated, cured for a few seconds up to minutes at 120° to 190° C.

The coating compositions and the finishing solutions can also contain other substances suitable for the treatment of textiles, such as finishing agents. Suitable finishing agents include aminoplast resins and silicone elastomers. Softening and flame-proofing agents and their corresponding catalysts may also be included.

The process according to the invention is suitable for treating textiles of all types, whether these are in the form of woven or knitted fabrics or non-woven fibre structures. All these types may be produced from natural fibres, such as cellulose or keratin fibres, as well as from man-made fibres, such as polyacrylonitrile, polyamide, polyvinyl alcohol or polyester. It is also possible to treat textile materials which consist of mixtures of natural fibres with synthetic fibres. Lightly woven fabrics, such as taffeta or light poplin materials, can be given a water-tight and water-repellant finish by the process of the invention. This is important, for example, for rainproof clothing, such as anoraks and the like. Furthermore, the finishing in accordance with the present process is also particularly suitable for the treatment of awning materials and camping articles.

Using the process according to the invention, textile finishes are obtained which simultaneously show water-repelling properties and more especially, with coating, water-tight properties. These properties are surprisingly resistant to a high degree to dry cleaning and washing. Moreover, according to the process of the invention, a finish with a filling effect is imparted to the treated textiles. This finishing causes particularly improved crease resistance, an improvement in the "handle" and a reduced degree of pilling formation. It is surprising that these effects are established by the process according to the invention, since in this case a finishing with polymers is carried out and such polymers, according to the prior art, are unsuitable for producing water-tight and simultaneously water-repelling properties.

The invention will now be illustrated by the following Examples in which all parts and percentages are by weight unless otherwise indicated.

EXAMPLE 1

A 46% by weight copolymer dispersion having the following compositions was prepared in a conventional manner:

46% of copolymer, obtained from 0.5% itaconic acid, 9.25% acrylonitrile, 65.00% butyl acrylate, 18.50% 2-ethyl hexyl acrylate, and 6.75% N-methylol acrylamide 3.5% emulsifier, related to copolymer (nonylphenol polyglycol ether with 50 mole ethylene oxide per mole of nonylphenol), and remainder water.

The following coating compositions are prepared for coating polyamide woven fabrics (150 g/m$^2$) for anoraks:

Compostion I (prior art)

1000 g of the copolymer dispersion,
35 g of a 75% by weight, aqueous solution of dimethylol dihydroxyethylene urea,
200 g of tetrachlorethylene, and
12 g of thickening agent (carboxymethyl cellulose).

Composition II (according to the invention)

1000 g of the copolymer dispersion,
20 g of aminosilane of the formula (3),
20 g of dibutyl-tin diluarate,
200 g of tetrachlorethylene, and
12 g of thickening agent (carboxylmethyl cellulose).

Composition III (according to the invention)

As Composition II, but with
50 g of aminosilane of formula (3), and
50 g of dibutyl-tin dilaurate.

Composition IV (according to the invention)

As Composition II, but with
100 g of aminosilane of formula (3), and
100 g of dibutyl-tin dilaurate.

The coating was carried out by means of air doctors at a speed of 10 m per minute and the coated woven fabric was then continuously conducted through a heating duct (residence time 2 minutes) and dried and cured at 145° C. The coating weight was about 28 g/m$^2$. One part of the finished textiles was washed in the usual manner 3 times at 40° C. in a machine, while another part was dry cleaned (DC) 3 times, in the presence of 2 g/l of a conventional cleaning intensifier and 2 g/l of water.

The results, after being laid out for 5 days under normal climatic conditions, are set out in the following Table.

A water-repelling woven fabric was obtained which has a pleasing, soft handle. Furthermore, the crease resistance of the textile material thus treated was improved by comparison with the untreated material.

EXAMPLE 4

A tent fabric consisting of polyacrylonitrile fibres (200 g/m$^2$) was coated on one side with the following coating composition by means of an air doctor, the coating being effected with two strokes of the doctor (total solid application 50 g/m$^2$) and thereafter in each case conducted continuously through a heating duct (15 m per minute) dried and cured for 2 minutes at 150° C.:

1000 g of a 40% by weight non-ionic copolymer dispersion (82% butyl acrylate, 8% acrylonitrile, 8% N-methylol methacrylamide and 2% ethylene glycol diacrylate),
18g of a conventional red pigment dyestuff,

| | Spray Test according to DIN 53888 | | | | | | Water tightness according to DIN 53886 (water column in mm) | | |
|---|---|---|---|---|---|---|---|---|---|
| | Original | | 3 × 40° C Machine Washing | | 3 × DC | | | | |
| Finish | Original water absorption in % | Water-repellent effect | Water absorption in % | Water-repellent effect | Water absorption in % | Water-repellent effect | Original | 3 × 40° C machine washing | 3 × DC |
| I (prior art) | 6.0 | 2–1 | 11.4 | 2–1 | 20.3 | 1 | 750 | 440 | 90 |
| II (according to the invention) | 4.4 | 4–4–4 | 7.9 | 3–3–3 | 14.2 | 3–3–3 | above 1000 | 510 | 190 |
| III (according to the invention) | 4.3 | 4–4–4 | 7.0 | 3–3–3 | 8.7 | 3–3–3 | above 1000 | 700 | 510 |
| IV (according to the invention) | 4.3 | 4-4-4 | 6.9 | 3-3-3 | 8.6 | 3-3-3 | above 1000 | 680 | 490 |
| V (untreated) | 48 | 1 | — | — | — | — | 0 | — | — |

EXAMPLE 2

Example 1 was repeated, but in place of the copolymer dispersion as indicated therein, there was used the same quantity of a 48% by weight copolymer dispersion, which has the following composition:

48% by weight copolymer, obtained from 4.25% N-methylol acrylamide, 1% acrylamide, 0.45% itaconic acid, 19.3% acrylonitrile, and 75% butyl acrylate,
3% by weight emulsifier, based on copolymer (nonylphenol polyglycol ether with 30 moles ethylene oxide per mole of nonylphenol) and
remainder water.

Good results comparable with those produced in Example 1 were obtained and the finished textile additionally had a soft, smooth handle.

EXAMPLE 3

A cotton satin (310 g/m$^2$) was impregnated with an aqueous solution, containing:

200 g/l of a 45% by weight, aqueous copolymer dispersion which had been prepared in conventional manner from 5 parts of N-methylol methacrylamide, 2 parts of N-methoxymethyl acrylamide, 28 parts of methyl methacrylate and 65 parts of butyl acrylate (3.5% by weight, based on copolymer, of non-ionic emulsifier),
10 g/l of aminosilane of the formula (8), and
12 g/l of zinc octoate, and the impregnated material squeezed out to a solution absorption of about 85%, dried and cured for 2 minutes at 155° C.
25g of aminosilane of the formula (7),
20g of dioctyl-tin benzoate, and
25g of thickening agent (methyl cellulose).

The coated fabric was thereafter postimpregnated with the following aqueous solution:

30 g/l of hexamethylol melamine tetramethyl ether,
7 g/l of 35% aqueous zinc nitrate solution (pH value about 1, adjusted with hydrochloric acid),
2ml/l of 60% acetic acid,
45 g/l of the paraffin emulsion prepared according to Example 1 of U.S. Pat. No. 3,887,390.
9 g/l of about 25% oil-repellent emulsion (according to U.S. Pat. No. 2,803,615), and
40 g/l of the emulsion prepared according to Example 8 of U.S. Pat. No. 3,320,197.

The woven fabric was padded (solution absorption about 50%), dried at 130° C. and then cured at 150° C.

The coated fabric exhibited on the coated side, a very good water tightness which was resistant to weather influences. The water-repelling effect was excellent. The finishing was of a permanent nature.

EXAMPLE 5

A coarse woven cotton fabric (about 280 g/m$^2$) which had been pre-dressed in a conventional manner was coated on both sides thereof with the following coating composition by means of two doctoring strokes, using a roller-type doctor:

1000 g of a 35% non-ionic copolymer dispersion (polymer obtained from 85% vinyl acetate, 2% 2-ethylhexyl acrylate and 13% N-methylol acrylamide), (1)

35 g of aminosilane of the formula (2), (2)
35 g of dibutyl-tin diacetate, (3)
50 g of toluene, (4)
50 g of titanium dioxide, (5) and
15 g of thickening agent (carboxymethyl cellulose) (6).

(5) was formed into a paste with (4) and introduced while stirring vigorously into (1). Thereafter (2), (3) and (6) were added by mixing.

The woven fabric was provided with a coating of about 70 g/m$^2$ (solid substance) on each side. Drying was effected at 120° C., followed by curing for 30 seconds at 180° C.

The woven fabric thus treated exhibited a very stiff handle and also had a very good water repellency. The effects are resistant to wiping and washing.

EXAMPLE 6

The treatment of Example 1, Composition II was repeated, using 30 g of the amino-functional siloxane of the formula (12) and 45 g of tin caprylate as hardening agent. Comparable results were obtained, although the resistance to dry cleaning was less strongly pronounced.

EXAMPLE 7

A polyester Corduroy-rep jersey (300 g/m$^2$) was dyed in a conventional manner in water with a dispersion dyestuff and, after drying on the tentering frame, was treated on the rear side with the following aqueous solution by means of a roll, dipping in the treating liquor (solution absorption 130%):

50 g/l of a 45% copolymer dispersion prepared in a conventional manner (polymer obtained from 45.5% vinyl acetate, 30.5% butyl acrylate, 11.75% N-methylol allyl carbamate, 11.75% acrylamide and 0.5% maleic acid anhydride; emulsifier 2%, calculated on copolymer, octyl phenol polyglycol ether with 40 mole of ethylene oxide per mole of octyl phenol),
0.6 g/l of aminosilane of the formula (5), and
0.6 g/l of zirconium caprylate.

The jersey was dried at 120° C. and heat-fixed for 30 seconds at 180° C.

The treated fabric posesses a full, voluminous handle, good anti-pilling properties and good water-repulsion. The finish was resistant to washing and dry cleaning.

EXAMPLE 8

Example 4 was repeated, using the same quantity of the amino-functional siloxane of formula (10). 50 g of starch-tragacanth thickening (10 parts of wheat starch, 25 parts of tragacanth solution 65:100 and 65 parts of water) were used as thickening agent. A finish which was to a high degree water-tight and water-repellent was obtained, the finish exhibiting good permanent properties.

What we claim is:

1. A process for making textiles water-proof and water-repellent, comprising the steps of (a) applying to a textile an aqueous composition comprising a reactive copolymer which is stable to hydrolysis in the aqueous medium, which is a copolymer of ethylenically unsaturated monomers which include 1.5 to 20%, by weight of the copolymer, of a monomer which contains a carboxylic acid amide methylol group or a $C_1$–$C_3$ alkyl ether thereof or a mixture thereof; 0.5 to 15%, by weight of the copolymer, of an aminosilane or an aminosiloxane or a mixture thereof; and 0.5 to 15%, by weight of copolymer, of an organometallic catalyst; and (b) heating the treated textile to harden the copolymer thereon.

2. The process of claim 1, wherein the ethylenically unsaturated monomers include 2.5 to 12%, by weight based on the copolymer, of a monomer which contains a carboxylic acid amide methylol group or a $C_1$–$C_3$ alkyl ether thereof or a mixture of said etherified and non-etherified monomers.

3. The process of claim 1, wherein the ethylenically unsaturated monomers comprise 50 to 98.5%, by weight of the copolymer, of a non-reactive monomer selected from the group consisting of alkylacrylates wherein the alkyl group is of 1 to 8 carbon atoms, alkylmethacrylates wherein the alkyl group is of 1 to 8 carbon atoms, vinyl esters of saturated carboxylic acids, and mixtures thereof.

4. The process of claim 3, wherein the ethylenically unsaturated monomers comprise up to 25%, by weight of copolymer, of a monomer selected from the group consisting of ethylene, acrylonitrile, methacrylonitrile, acrylamide, styrene, vinylether, vinylchloride, vinylidene chloride, and mixtures thereof.

5. The process of claim 3, wherein the ethylenically unsaturated monomers comprise up to 1%, by weight of copolymer, of a monomer having a free carboxyl group.

6. The process of claim 3, wherein the ethylenically unsaturated monomers comprise less than 5%, by weight of copolymer, of a non-reactive monomer having two polymerizable double bonds.

7. The process of claim 1, wherein the aminosilane is of the formula $$M-A-\overset{\overset{Y_n}{|}}{Si}-(OY)_{3-n}$$

wherein

Y is alkyl of 1 to 3 carbon atoms,
A is alkylene of greater than two carbon atoms,
M is an amino group or an aminoalkylamino group, and
*n* is 0 or 1.

8. The process of claim 1, wherein the amino-siloxane is the hydrolysate of an aminosilane of the formula $$M-A-\overset{\overset{Y_n}{|}}{Si}-(OY)_{3-n}$$

wherein

Y is alkyl of 1 to 3 carbon atoms,
A is alkylene of greater than two carbon atoms,
M is an amino group or an aminoalkylamino group, and
*n* is 0 or 1;

or a cohydrolysate of an aminosilane of said formula and a silane having no amino group.

9. The process of claim 1, wherein the organometallic catalyst is a compound of aluminum, zirconium, titanium, cobalt, iron, zinc or tin.

10. The process of claim 1, wherein the organometallic catalyst is a zinc soap.

11. The process of claim 1, wherein the organometallic catalyst is a dialkyl-tin dicarboxylate.

12. The process of claim 1, wherein the aqueous composition comprises 0.5 to 10%, by weight of copolymer, of the aminosilane or aminosiloxane or mixtures thereof and 0.5 to 10%, by weight of copolymer, of the organometallic catalyst.

13. The process of claim 12, wherein the aqueous composition comprises 2 to 8%, by weight of copolymer, of the aminosilane or aminosiloxane or mixtures thereof and 2 to 8%, by weight of copolymer, of the organometallic catalyst.

14. The process of claim 12, wherein the aqueous composition is applied to the textile by coating, and wherein the aqueous composition contains 15 to 60% by weight of the reactive copolymer, based on the total weight of the composition.

15. The process of claim 14, wherein the ethylenically unsaturated monomers include 2.5 to 20%, by weight of the copolymer, of a monomer which contains a carboxylic acid amide methylol group or a $C_1$–$C_3$ alkyl ether thereof or a mixture thereof; 0.5 to 10%, by weight of the copolymer, of an aminosilane of the formula $$M-A-\overset{\overset{Y_n}{|}}{Si}-(OY)_{3-n}$$

wherein

Y is alkyl of 1 to 3 carbon atoms,

A is alkylene of greater than two carbon atoms,

M is an amino group or an aminoalkylamino group, and $n$ is 0 or 1, or an aminosiloxane which is the hydrolysate of an aminosilane of the formula, or a mixture of an aminosiloxane and a siloxane containing no amino group which is the cohydrolysate of an aminosilane of the formula and a silane containing no amino group, or mixtures thereof; 0.5 to 10%, by weight of copolymer, of an organometallic catalyst selected from the group consisting of zinc soaps and dialkyl-tin dicarboxylates; and sufficient thickening agent to give a viscosity of 10,000 cP at 20° C.

16. The process of claim 12, wherein the aqueous composition is applied to the textile by impregnation, and wherein the aqueous compositon contains 4 to 100 g/l of the reactive copolymer.

17. The process of claim 16, wherein the ethylenically unsaturated monomers include 2.5 to 20%, by weight of the copolymer, of a monomer which contains a carboxylic acid amide methylol group or a $C_1$–$C_3$ alkyl ether thereof or a mixture thereof; 0.5 to 10%, by weight of the copolymer, of an aminosilane of the formula $$M-A-\overset{\overset{Y_n}{|}}{Si}-(OY)_{3-n}$$

wherein

Y is alkyl of 1 to 3 carbon atoms,

A is alkylene of greater than two carbon atoms,

M is an amino group or an aminoalkylamino group, and $n$ is 0 or 1, or an aminosiloxane which is the hydrolysate of an aminosilane of the formula, or a mixture of an aminosiloxane and a siloxane containing no amino group which is the cohydrolysate of an aminosilane of the formula and a silane containing no amino group, or mixtures thereof; and 0.5 to 10%, by weight of copolymer, of an organometallic catalyst selected from the group consisting of zinc soaps and dialkyl-tin dicarboxylates.

* * * * *